US009679716B2

(12) United States Patent
Faurie et al.

(10) Patent No.: US 9,679,716 B2
(45) Date of Patent: Jun. 13, 2017

(54) MODULAR ELECTROMECHANICAL SWITCHING ELEMENT

(71) Applicant: Siemens Aktiengesellschaft, Munich (DE)

(72) Inventors: Jean Jacques Faurie, Nuremberg (DE); Khalil Hadir, Ebermannsdorf (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 14/966,753

(22) Filed: Dec. 11, 2015

(65) Prior Publication Data

US 2016/0181030 A1 Jun. 23, 2016

(30) Foreign Application Priority Data

Dec. 19, 2014 (EP) ..... 14199290

(51) Int. Cl.

*H01H 19/14* (2006.01)
*H01H 19/03* (2006.01)
*H01H 19/635* (2006.01)
*H01H 19/54* (2006.01)

(52) U.S. Cl.

CPC ..... *H01H 19/14* (2013.01); *H01H 19/03* (2013.01); *H01H 19/54* (2013.01); *H01H 19/6355* (2013.01)

(58) Field of Classification Search

CPC ..... H01H 19/03; H01H 19/54; H01H 19/14; H01H 19/6355
USPC ... 200/336, 6 A, 16 A, 43.08, 564, 566, 568
See application file for complete search history.

(56) References Cited

U.S. PATENT DOCUMENTS 4,282,414 A * 8/1981 Johnston ..... H01H 11/0006 200/16 A
6,025,564 A * 2/2000 Verduci ..... B60Q 1/1476 200/61.27
6,274,835 B1 8/2001 Mo
7,870,810 B2 1/2011 Da Dalt et al.
2008/0141744 A1 6/2008 Desaphie et al.

FOREIGN PATENT DOCUMENTS

DE 3541390 A1 8/1986
DE 602005003022 T2 8/2008

* cited by examiner

*Primary Examiner* — Edwin A. Leon
(74) *Attorney, Agent, or Firm* — Cozen O'Connor

(57) ABSTRACT

An electromechanical switching device for providing an electrical connection between terminals as a function of a switched state based on a manual activation, where the switching device has a rotatably mounted activation unit that can be activated manually and a switching unit which is connectable to the activation unit, the switching unit provides pat least two electrical terminals and electrically interconnects them as a function of the electrical switched state, for which purpose the switching unit has at least one switching element slideably mounted in a longitudinal direction of the switching device, the switching device has a coupling unit that mechanically interconnects the activation and switching units and that is configured to transmit the manual activation of the activation unit to the switching element of the switching unit, and where the electromechanical switching device is formed in a modular manner via at least the activation, coupling unit and switching units.

14 Claims, 11 Drawing Sheets

MODULAR ELECTROMECHANICAL SWITCHING ELEMENT

BACKGROUND OF THE INVENTION

1. Field of the Invention

The present invention relates to an electromechanical switching device for making available an electrical connection between at least two terminals as a function of a switched state on the basis of a manual activation, where the electromechanical switching device is configured to be arranged in a switchboard of an electrical control device and has an activation unit that is rotatably mounted and can be activated manually and a switching unit which is connectable to the activation unit, where the switching unit makes available the at least two electrical terminals of the electromechanical switching device and electrically connects them to one another as a function of the electrical switched state, for which purpose the switching unit has at least one switching element that is mounted so as to be slideable in a longitudinal direction of the electromechanical switching device.

2. Description of the Related Art

Electromechanical switching devices of the generic type are basically known with the result that no separate documented evidence for them is necessary. They are usually used in switchboards that serve to control electrical systems, at least partially electrically operated machines, combinations thereof or the like. Here, the electromechanical switching devices serve, in particular, to activate or deactivate electrically controllable functions that are usually activated or deactivated by a control voltage in the form of a low voltage. In this context, it has become accepted practice mainly to use rotationally activated electromechanical switching devices for the electromechanical switching elements. As a result, on the one hand, simple handling can be achieved and, on the other hand, simple mounting and arrangement in the switchboard can be implemented. The switchboard can be formed by a wall that can be formed from a metallic material, such as sheet steel. However, it can also be formed from a plastic or a composite material. In addition, the switchboard can, however, also be formed as a switch box or as a switch cabinet and can make available a closed-off cavity in which electrical lines are preferably connected.

The switchboard usually has an opening that is adapted to external dimensions of the electromechanical switching device and into which the electromechanical switching device is inserted and attached.

On the operator control side, the rotatably mounted activation unit, which can be activated manually, protrudes beyond a surface of the switchboard, with the result that it can be activated manually by an operator. In contrast, the switching unit that is connected to electrical lines via terminals of the switching unit to form or interrupt an electrical connection between two or more of the electrical lines in accordance with the respective current switched state of the electromechanical switching unit protrudes at the back.

On the activation side, essentially two different embodiments can be differentiated, specifically a key-activated activation unit and secondly a rotary toggle lever activation unit. Furthermore, there are a multiplicity of different refinements with respect to the switching unit and the switched states which can be assumed.

For these different electromechanical switching elements, there are respective separate designs that give rise to a multiplicity of different electromechanical switching devices and which require corresponding expenditure for manufacture.

SUMMARY OF THE INVENTION

The object of the invention is to reduce the expenditure on an electromechanical switching unit.

This and other objects and advantages are achieved in accordance with the invention by providing an electromechanical switching device that has a coupling unit that mechanically interconnects the activation unit and a switching unit to one another and which is configured to transmit the manual activation of the activation unit to a switching element of the switching unit, where the electromechanical switching device is formed in a modular manner by at least the activation unit, the coupling unit and the switching unit.

The coupling unit ensures that the electromechanical switching device can be manufactured in a modular manner from the activation unit, coupling unit and switching unit components, combined in virtually any desired manner. Specific, preferably standardized, connections can be provided between the coupling unit and the activation unit as well as the coupling unit and the switching unit via the coupling unit. As a result, an electromechanical switching device of any desired type can be assembled easily from a kit composed of few components. In this context, it proves particularly advantageous that even the individual components, specifically the coupling unit, the activation unit and the switching unit as well as the elements assigned thereto can be used as pre-tested assemblies. As a result, the manufacture of electromechanical switching devices can be considerably simplified, with the result that very different electromechanical switching devices can be manufactured according to needs, even within a short period. With the invention it is therefore possible to make the fabrication of electromechanical switching devices considerably more flexible. Furthermore, the invention permits the individual components of the electromechanical switching device, specifically the coupling unit, the activation unit and the switching unit, to be manufactured separately at different times and at different locations, and only then to be combined to form the electromechanical switching device if corresponding orders have been received. The modules can be formed by the activation unit, the coupling unit and the switching unit.

The invention proves particularly advantageous especially for the application that is generally provided in the low-voltage range according to the standard, in particular the guideline 2006/95/EC of the European Parliament and of the European Council of 12 Dec. 2006 for harmonizing the legal requirements of the Member States regarding electrical equipment for use within certain voltage limits. As is known, particular technical requirements, which also have to satisfy particular tests, are made of such electromechanical switching devices. Despite this particular expenditure in terms of electrical safety, with the invention it is possible to implement the modular design which permits favorable fabrication of the electromechanical switching devices.

The electromechanical switching device is, as a rotationally activated electromechanical switching device, typically provided with a longitudinal axis that generally, at the same time, also constitutes a rotational axis with respect to the rotatable bearing of an activation element of the activation unit. In specific embodiments, the axes may also deviate from one another. For the sake of electrical safety, the electromechanical switching device is usually divided into two regions, specifically a region for manual activation, which is sufficiently electrically insulated with respect to an electrically active region that makes available the actual switching function in accordance with the switched state of the electromechanical switching device. Furthermore, the switching unit generally also makes available the terminals between which the electrical connection is formed or disconnected in accordance with the respective switched state. On the basis of this configuration, the activation region usually protrudes out of the switchboard, whereas the active region is disconnected (i.e., in particular shielded) from the activation region by the switchboard, i.e., with respect to the electrical safety and the electrical insulation.

The coupling unit preferably constitutes a connecting region that is correspondingly coupled in a rotatable manner to the activation unit for transmitting a rotational movement of the activation unit. For example, the connection can be formed by virtue of the fact that the coupling unit has an encoded receptacle for a correspondingly oppositely encoded projection of the activation element, with the result that a rotationally fixed connection can be brought about between the two. However, it can also be provided that a latching element of the activation unit engages in a latching receptacle of the coupling unit to form the rotational connection.

The coupling unit is also provided for converting the rotational movement, which is applied to the coupling unit by means of the activation element, into a translatory movement, and for correspondingly sliding the switching element of the switching unit in a translatory fashion. As a result, the switching element can implement the desired switched state. Corresponding axial positions of the switching element are therefore brought about in accordance with the respective rotational positions of the activation element. Corresponding contacts that are connected to the terminals of the switching unit are switched in accordance with the respective positions of the switching element in relation to the respective switched states. As a result, a multiplicity of switching functions can be implemented in a desired manner with only a few components by the electromechanical switching device in accordance with the invention.

The switching element itself can be formed, for example, in an axially sliding manner and can have one or more electrically conductive regions by which electrical connections can be formed between contacts of the switching unit or interrupted.

In accordance with one advantageous embodiment, the coupling unit has a rotational-angle-limiting disk that has at least one rotational-angle-limiting element. The rotational-angle-limiting disk is preferably arranged in the connecting region between the coupling unit and the activation unit. A rotational angle of the activation element can be set in a predefinable manner with the rotational-angle-limiting disk. For example, the rotational angle can be limited to 90 degrees. Furthermore, the rotational angle can also be limited to 45 degrees. The rotational-angle-limiting disk is advantageously configured to be able to limit a plurality of rotational angles. Through corresponding setting or assembly of the rotational-angle-limiting disk, it is possible to ensure that a respective limiting angle can be set in relation to manual activation of the activation unit. The rotational-angle-limiting elements can be formed, for example, by cutouts (i.e., openings) in the rotational-angle-limiting disk. The cutout preferably extends over a rotational angle region that permits an actuating range over the desired rotational angle.

In accordance with another embodiment, the rotational-angle-limiting disk is arranged in a rotationally fixed manner with respect to the switching unit. The rotational-angle-limiting disk is particularly advantageously connected to the switching unit via the coupling unit. As a result, it is possible to define the permissible rotational angle with respect to the switching unit as a reference point.

Another embodiment in accordance with the invention proposes that the coupling unit has a link element that interacts with a crown element. In accordance with the contemplated embodiment, it is easily possible to convert the rotational activation of the activation unit into an axial movement that acts on the switching element. At the same time, it is possible for the crown element to connect in a rotationally fixed manner to the link element, where the crown element is arranged in an axially movable manner and interacts with an insertion base that is arranged secured in a rotationally fixed manner in a rosette and in the longitudinal direction of the electromechanical switching device, in order to make available the desired latching and/or instantaneous-contact functions. The link element preferably makes available a link that acts on the switching element and converts a rotational movement into an axial movement of the switching element. Therefore, the link element is preferably rotatably mounted and connected in a rotationally fixed manner to a rotational axis of the activation unit. As a result, the rotational movement of the activation unit can act directly on the link element. In this way, a simple and easy-to-control arrangement can be achieved.

Furthermore, the crown element is mounted so as to be rotatable with the link element and so that it is slideable in the link element in the longitudinal direction of the electromechanical switching device. As a result, it is possible, for interaction with the link element, to convert a rotational activation of the activation unit into a longitudinal movement and to cause the activation unit act on the switching device. For this, the switching element preferably has at least one contact region that interacts with the link which is made available by the link element. The slideable bearing of the crown element in the link element permits a crown link that faces the insertion base to interact with the insertion base and as a result make available desired mechanical functions, such as latching and/or instantaneous contact For example, for this purpose one or more bearing points for the crown element can be provided in the link element.

It proves to be particularly advantageous if the crown element is prestressed in the direction of the insertion base. As a result, on the one hand, it is possible to ensure that the crown element is continuously in engagement with the insertion base, specifically independently of a rotational position of the activation element.

Furthermore, the coupling unit has a modular configuration in particular as a separate module, in each case with a crown element, a link element and a spring. With the modular configuration, it is possible to be able to produce the electromechanical switching device easily and flexibly in a way that is compatible with requirements and in a multiplicity of functional configurations. The modules can be formed by elements of the coupling unit. As a result, the basic mechanical design of the electromechanical switching device can be maintained essentially independently of the modules that are used.

In accordance with a further embodiment, the crown element and/or the link element are arranged in an exchangeable manner in the coupling unit. The present embodiment permits an electromechanical switching device to be equipped with another function, even through retrofitting. For this purpose, it is then easily possible for the crown element and/or the link element to be exchanged.

Standardized dimensions for the crown element and/or the link element are preferably provided, with the result that they can easily be exchanged as desired in the coupling unit.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

Further advantages and features can be found in the following description of exemplary embodiments. In the figures, identical components and functions are denoted by identical reference symbols, in which.

DETAILED DESCRIPTION OF THE EXEMPLARY EMBODIMENTS

Figure 1:
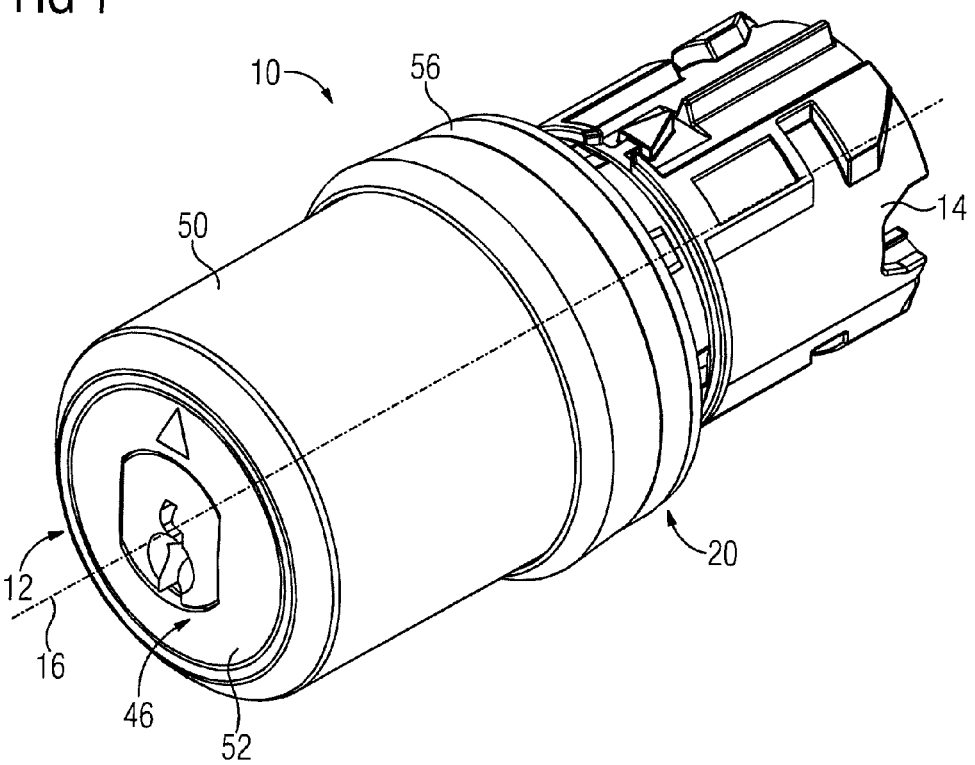
FIG. 1 shows a schematic-perspective view of a modular electromechanical switching device in accordance with the invention.

FIG. 1 shows a first embodiment of an electromechanical switching device 10 in accordance with the invention, where the switching device serves to make available an electrical switched state as a function of a manual activation. The electromechanical switching device 10 is also configured to be arranged in a switchboard (not illustrated) of an electrical control device (not illustrated further). The electromechanical switching device 10 has, in this first exemplary embodiment, a rotatably mounted activation unit 46, which can be activated manually, in the form of a lock 46 which can be activated by key. In addition, the electromechanical switching device 10 has a switching unit 14 which can be connected to the lock 46 and makes available here two electrical terminals 62 of the electromechanical switching device 10 and electrically connects them to one another as a function of the electrical switched state and has a switching element 18 (FIG. 3) which is mounted so as to be slideable in a longitudinal direction 16 of the electromechanical switching device 10. The switching unit 14 is configured to assume the switched state as a function of the activation of the lock 46.

In addition, the electromechanical switching device 10 of FIG. 1 comprises a coupling unit 20 that connects the lock 46 and the switching unit 14 to one another mechanically. The coupling unit 20 is also configured to transmit the manual activation of the lock 46 to the switching element 18 of the switching unit 14.

Figure 2:
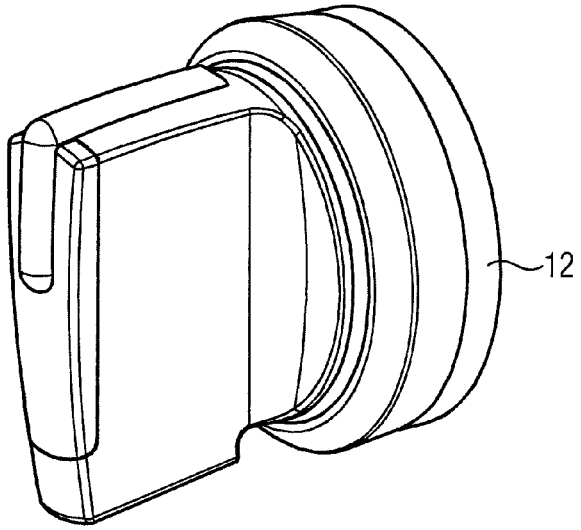
FIG. 2 shows a schematic-perspective illustration of a rotary toggle lever as an activation unit for the electromechanical switching device in accordance with the invention.

FIG. 2 shows, in a perspective schematic view, a second embodiment of an activation unit in accordance with the invention, specifically a rotary toggle lever 12. The latter can be mounted instead of the lock 46 of FIG. 1.

An essential aspect of the invention, specifically the kit principle of the electromechanical switching device 10, is already apparent from FIGS. 1 and 2. Both embodiments of the electromechanical switching device 10 of FIGS. 1 and 2 are based basically on a comparable design. This is illustrated further by FIG. 3 and FIG. 4.

Figure 3:
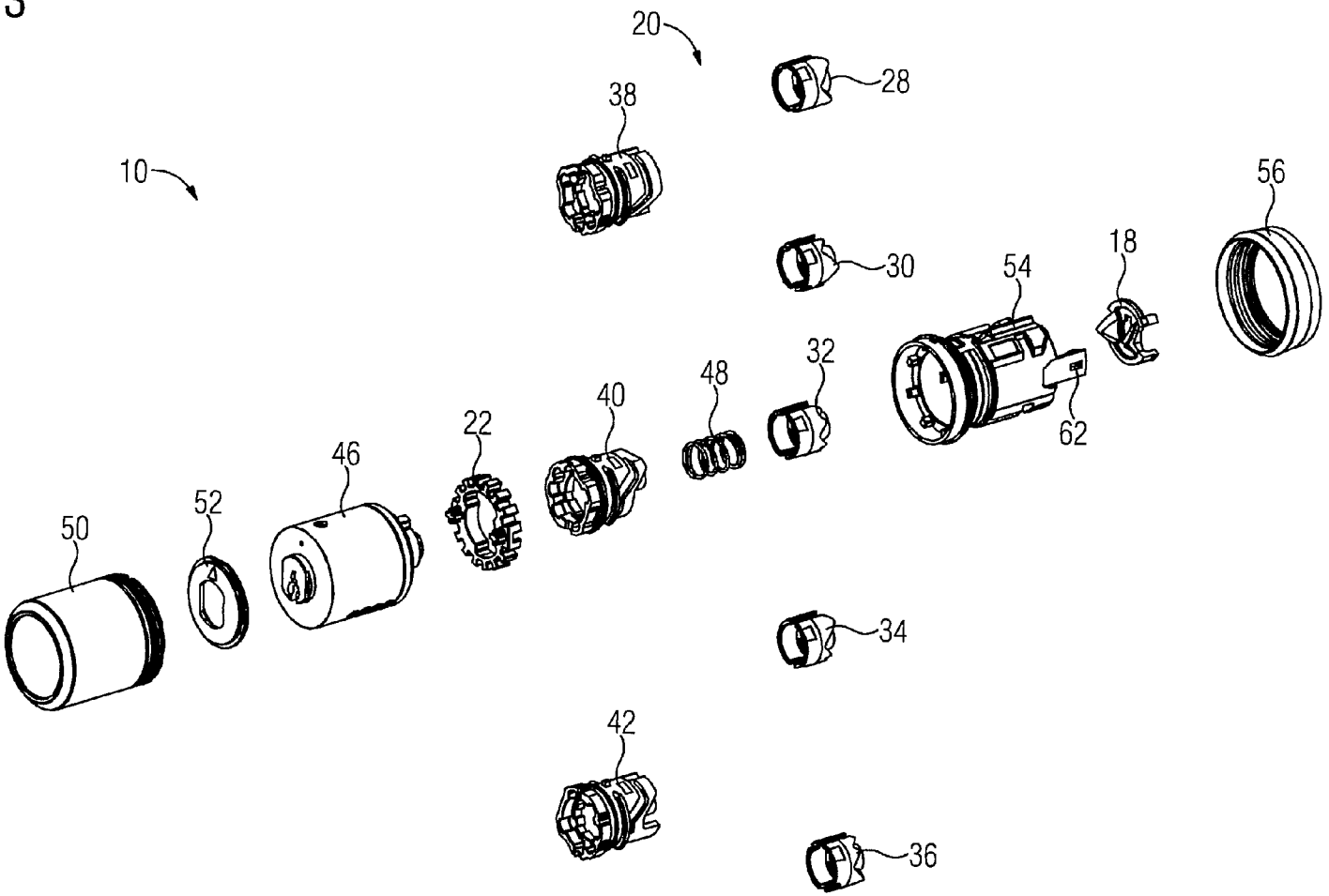
FIG. 3 shows a schematic exploded illustration of the electromechanical switching device of FIG. 1, where optionally usable components are illustrated.

FIG. 3 shows a perspective-schematic exploded illustration of the electromechanical switching device 10 of FIG. 1 with optional refinements for the coupling unit 20. Here, the lock 46 is arranged in a rotationally fixed manner in a sleeve 50. The lock 46 comprises a rotatably mounted locking cylinder (not denoted) which can be rotatably activated after the insertion of a fitting key, i.e., a key with a corresponding key code. On the front side, the lock cylinder is surrounded by an indicator disk 52 that is secured axially in the longitudinal direction 16 of the electromechanical switching device 10, between the sleeve 50 and the lock 46.

On an end side, lying opposite the indicator disk 52 of the lock 46, a stop disk 22 is arranged by which a rotational angle for the manual activation of the lock 46 can be limited or set. In this regard, the stop disk 22 forms a rotational-angle-limiting unit.

The coupling unit 20, which comprises here a selection of three possible link elements 38, 40, 42, a spring 48 and a selection of crown elements 28, 30, 32, 34, 36, adjoins on the stop-disk side. Depending on the desired switching and/or activation function, link elements and crown elements can be combined with one another. The coupling unit 20 is accommodated on the lock side in a rosette 54 together with the stop disk 22, which rosette 54 also at the same time makes available connecting contacts of the terminals 62 on the end side. Here, the terminals serve to connect electrical lines between which a desired switching function is to be implemented. In order to be able to implement the desired switching function between the switching contacts of the terminals 62, a slider 18 is also mounted in the rosette 54 so as to be axially slideable in the direction 16. The rosette 54 can be connected to the sleeve 50 by a front ring 56. For this purpose, corresponding threads (not illustrated) are provided, with the result that these components can be screwed to one another.

Figure 4:
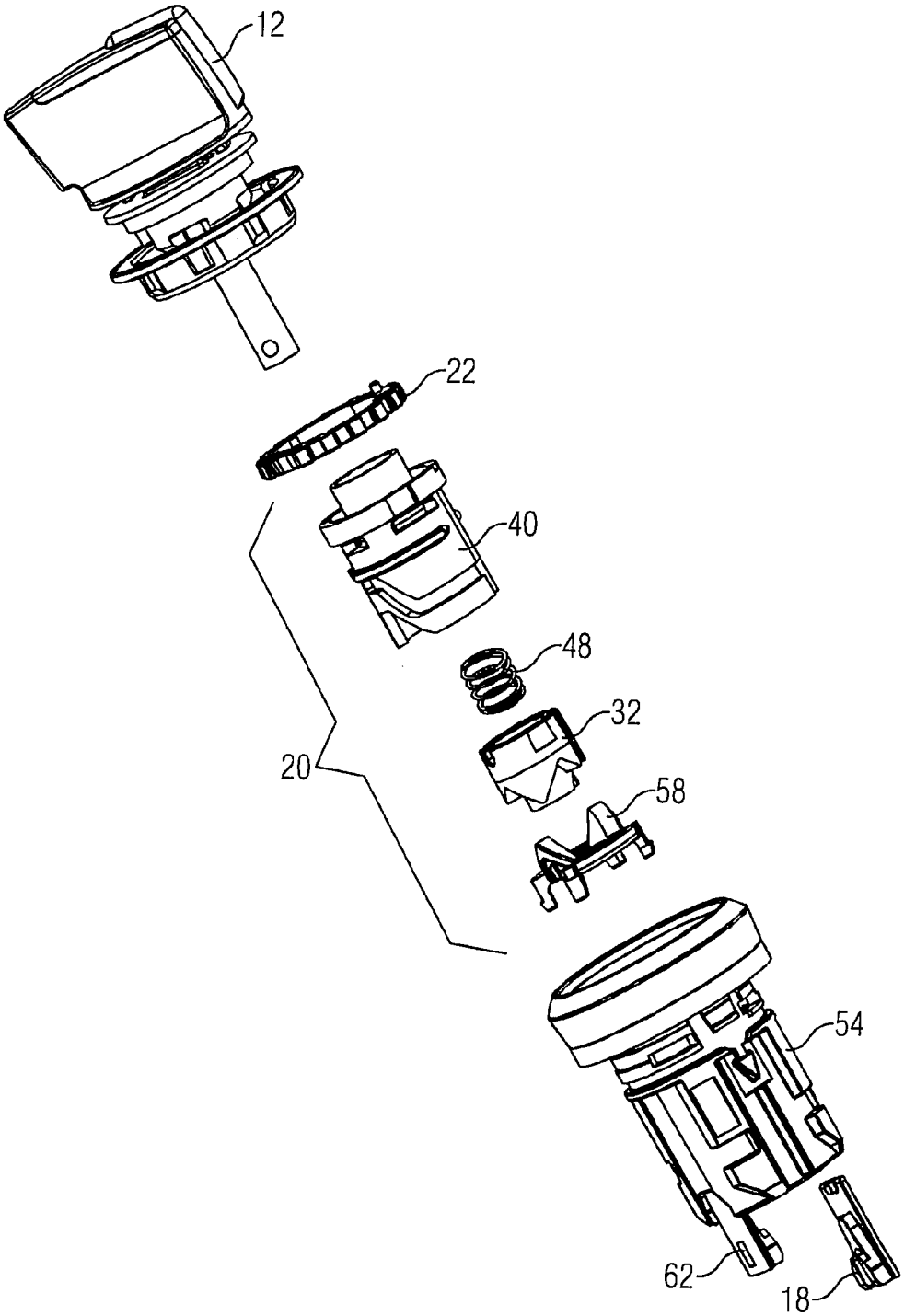
FIG. 4 shows a further electromechanical switching device of the invention in a perspective exploded illustration with an activation unit of FIG. 2.

FIG. 4 shows a corresponding illustration of an electromechanical switching device 10 with a rotary toggle lever 12 of FIG. 2. The present embodiment corresponds otherwise basically to how it has already been explained with respect to FIG. 3, for which reason reference is made additionally to the statements in this regard. The difference between the electromechanical switching device 10 of FIG. 4 and that of FIG. 3 is essentially that the lock 46 is replaced by the rotary toggle lever 12. This indicates that the electromechanical switching device 10 in accordance with the invention is of a modular configuration and components can be assembled in a way that is compatible with requirements, in order to be able to form the respectively desired electromechanical switching device. The activation can be performed, for example, either by a handle in the form of the rotary toggle lever or else via activation of a lock by a key. Each of these elements is connected to the corresponding link element in either a frictionally locking or positively locking manner.

The link element serves to convert the rotational movement into a translatory movement with respect to the slider. Accordingly, the rotational movement is transmitted to the slider 18 by a link of the link element.

In addition, the crown element is mounted in a longitudinally slideable manner in the direction 16 in the link element. At the same time, the crown element is connected in a rotationally fixed manner to the link element. As a result, the crown element follows a rotational movement of the link element. The crown element has a crown link that faces the one insertion base 58. The insertion base 58 is arranged in the rosette 54 in a rotationally fixed manner and is secured in the longitudinal direction 16. Owing to a prestress by the spring 48, the crown link bears against a projection (not denoted) in the insertion base 58. As a result of the guiding cam, made available by this structure, in the crown element and in the insertion base, these elements slide one on the other, with the result that a latching function and/or an instantaneous-contact function can be brought about.

It is therefore possible to use contours of the crown elements to implement functions such as latching or performing instantaneous contact both in connection with a lock as well as in connection with a rotary toggle lever. For example, five variants are possible, where the crown elements for both types of electromechanical switching devices can be identical.

The following variants of latching and performing instantaneous contact can be implemented in this embodiment:

Symbol (-) is equal to latching

Symbols (> or <) are equal to instantaneous contact to the left or to the right 3 positions latching: L-C-R 2 positions instantaneous contact: L>R 2 positions latching: L-R 2 positions instantaneous contact: L<R 3 positions instantaneous contact: L>C<R 3 positions latching/instantaneous contact: L-C<R 3 positions instantaneous contact/latching: L>C-R The link element makes available the function of permitting a dual actuator or a triple actuator as a rotational activation unit. In the present embodiment, three variants are respectively present. The differences are the incorporation of the activation unit 12, 44, 46. The activation unit 12, 44, 46 is latched to the link element 38, 40, 42. For example, the lock 46 is connected in a positively locking fashion to the link element 38, 40, 42.

Figure 8:
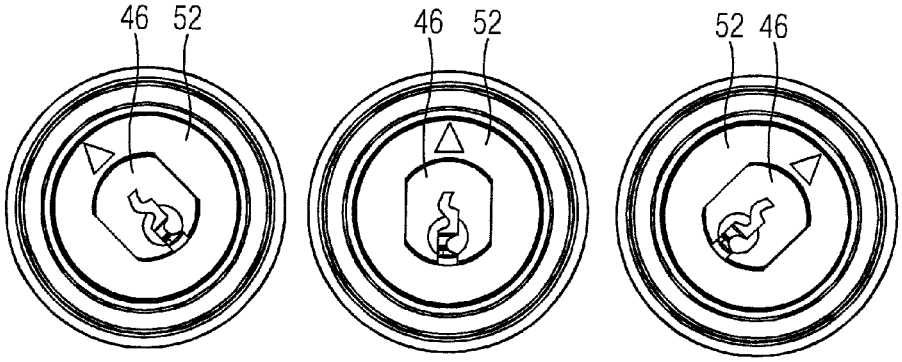
FIG. 8 shows a schematic view of three possible home positions which can be implemented with the assembly of FIG. 7.

As a result of the positioning of the activation unit 12, 44, 46 in relation to the respective link element 38, 40, 42, a home position of the activation unit 12, 44, 46 can be defined. In the present embodiment, three variants are provided, specifically left, center and right (FIG. 8). The corresponding home positions are illustrated one next to the other in FIG. 8.

Figure 5:
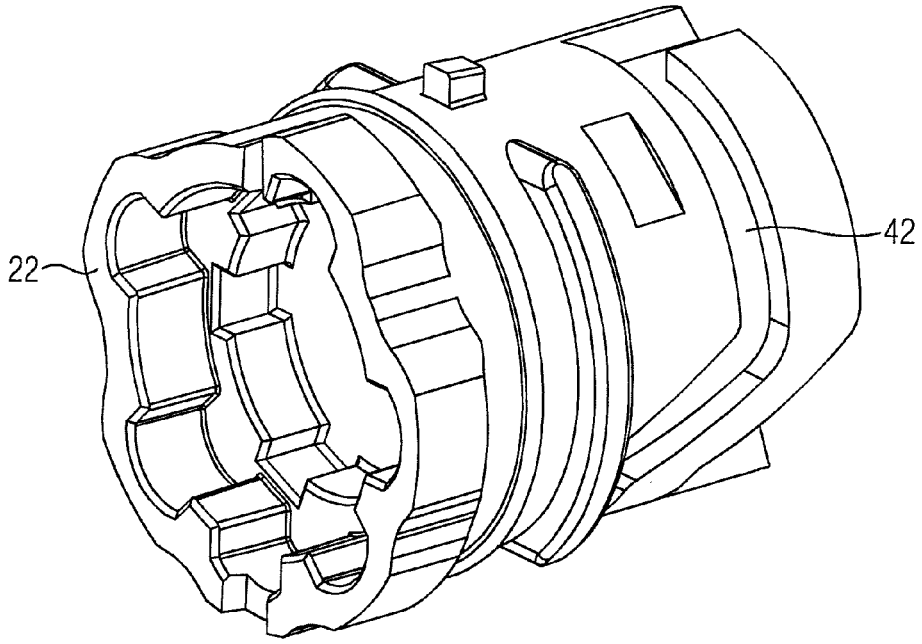
FIG. 5 shows a schematic-perspective view of a stop disk in conjunction with a link element.
Figure 6:
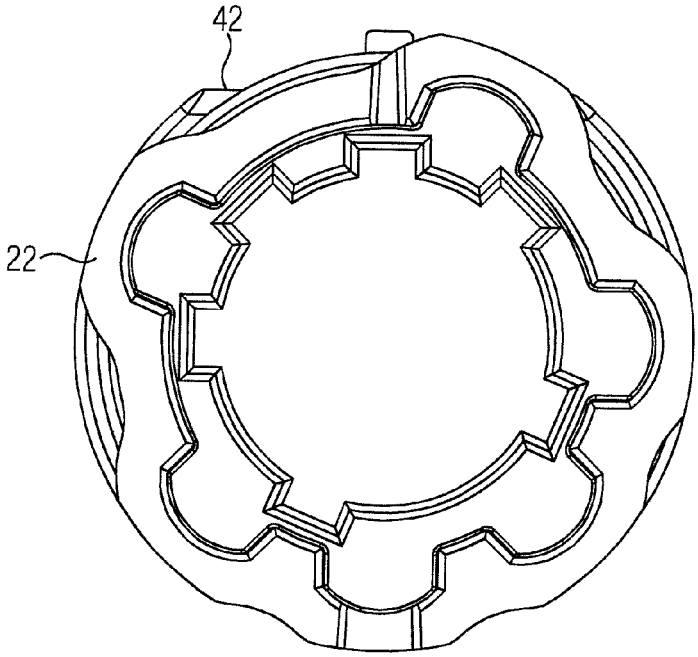
FIG. 6 shows a schematic plan view of the arrangement of FIG. 5.
Figure 7:
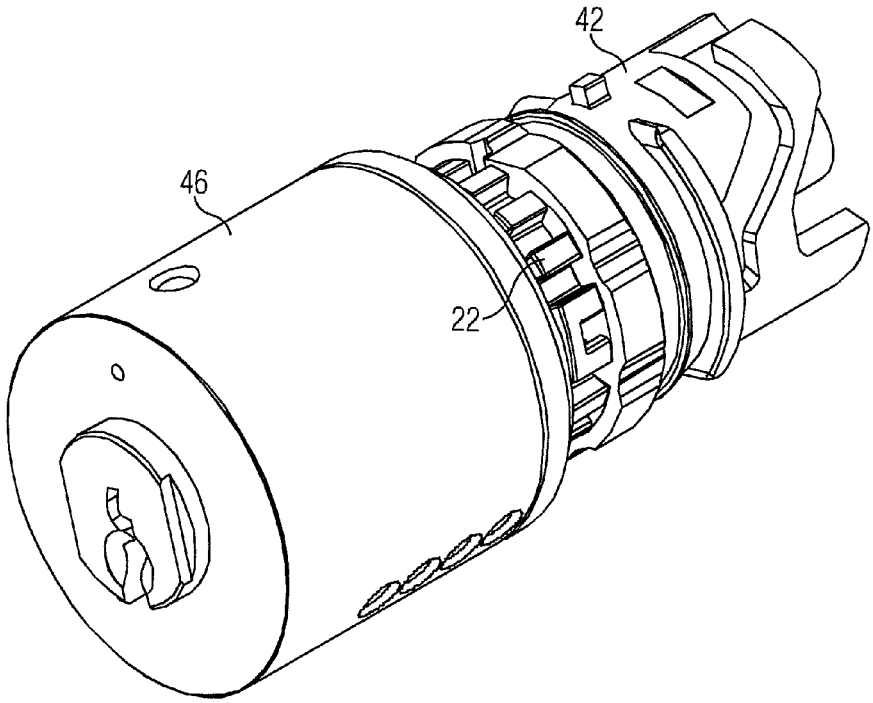
FIG. 7 shows a schematic-perspective view of a lock in conjunction with the assembly illustrated of FIGS. 5 and 6.

In FIGS. 5 and 6, an arrangement of one of the link elements, here the link element 42, with the stop disk 22 is illustrated in a schematic illustration.

Figure 9:
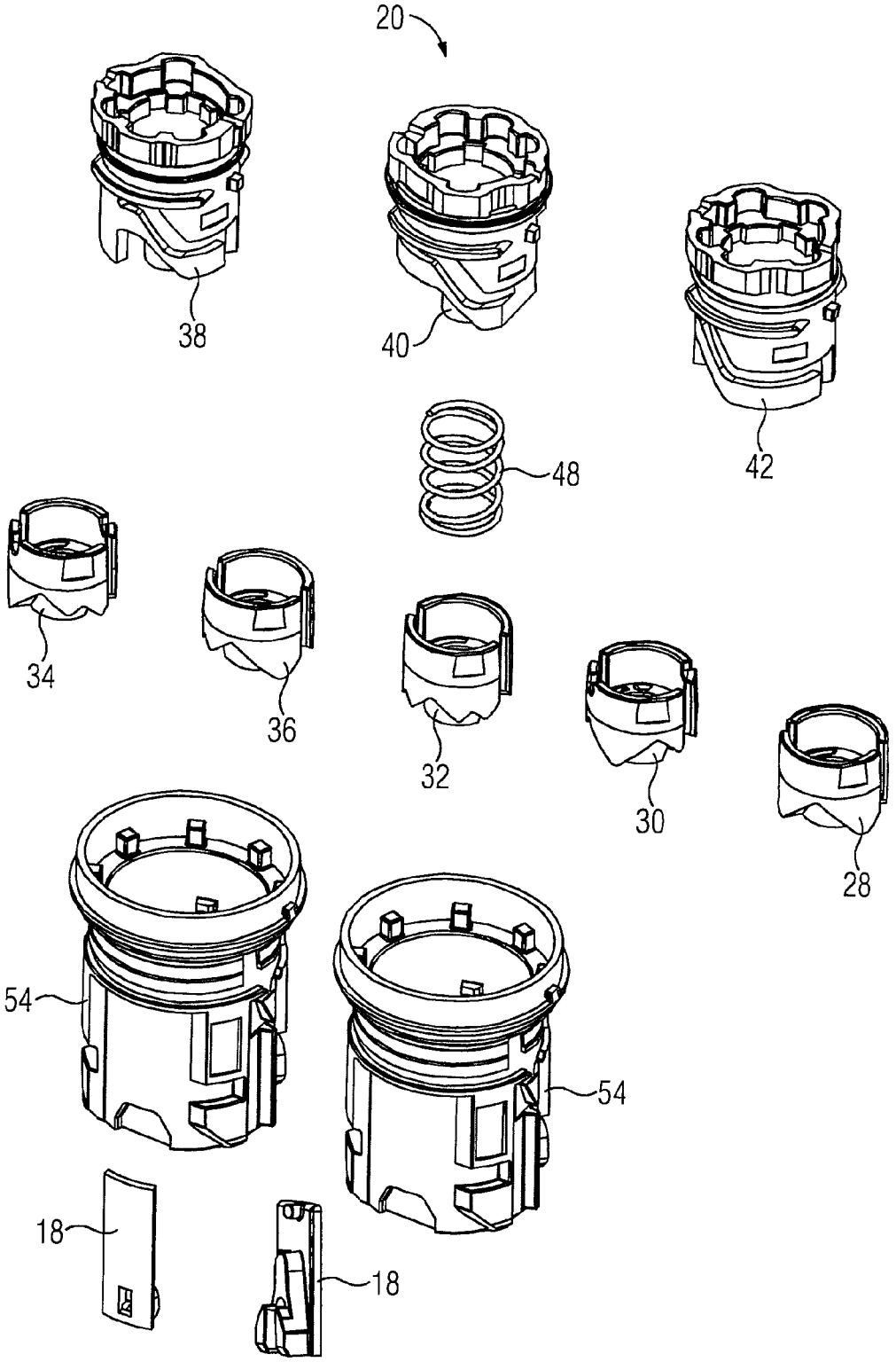
FIG. 9 shows a schematic, cut-out exploded illustration of possibilities for the coupling unit in conjunction with the switching unit.

FIG. 9 shows in a perspective exploded and schematic illustration different elements that can be combined to form the coupling unit 20. It is apparent that one of three link elements 38, 40, 42 can be combined in each case with one of the crown elements 28, 30, 32, 34, 36. In addition, the spring 48 is provided. These elements can be arranged in a respective rosette 54. Each of the link elements 38, 40, 42 has a cutout (not designated) into which a latching projection (not denoted either) of a respective activation unit 12, 44, 46 can engage. As a result, the respective link element 38, 40, 42 can be connected in a rotationally fixed manner to the respective rotatable element of the activation unit 12, 44, 46. The respective home position can be defined depending on the positioning of the activation unit 12, 44, 46 in relation to the link element 38, 40, 42.

Figure 10:
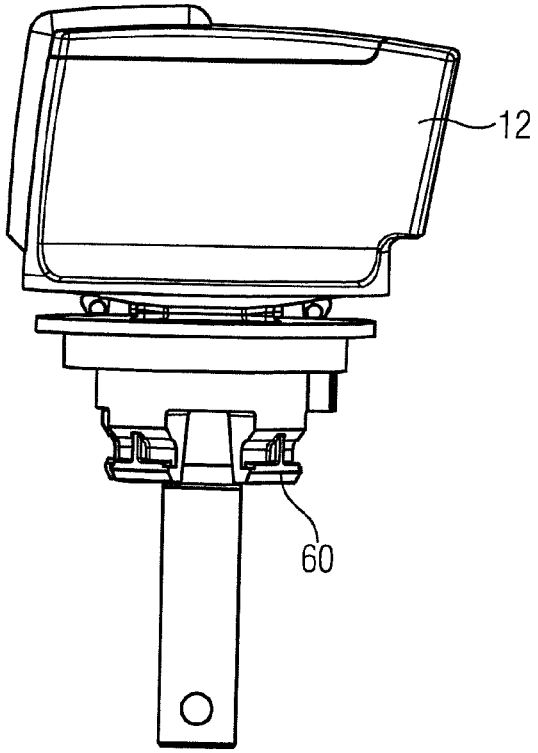
FIG. 10 shows a schematic side view of a first rotary toggle lever as an activation unit in accordance with the invention.
Figure 11:
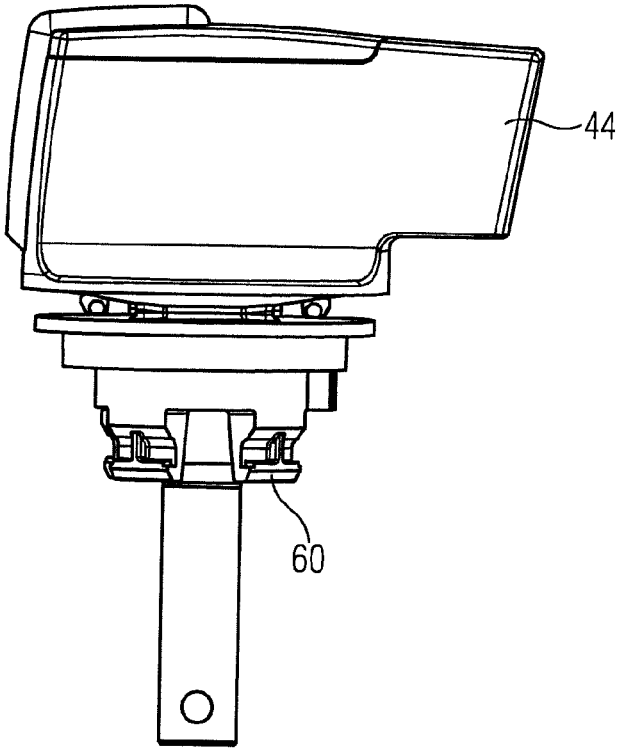
FIG. 11 shows a schematic side view of a second rotary toggle lever as an activation unit in accordance with the invention.

FIGS. 10 and 11 show rotary toggle levers 12, 44 as activation units, where respective latching hooks 60 that are in engagement with the cutouts (designated above) of the respective link elements 38, 40, 42 are provided on the link side if a respective link element is connected to the respective rotary toggle lever.

Figure 12:
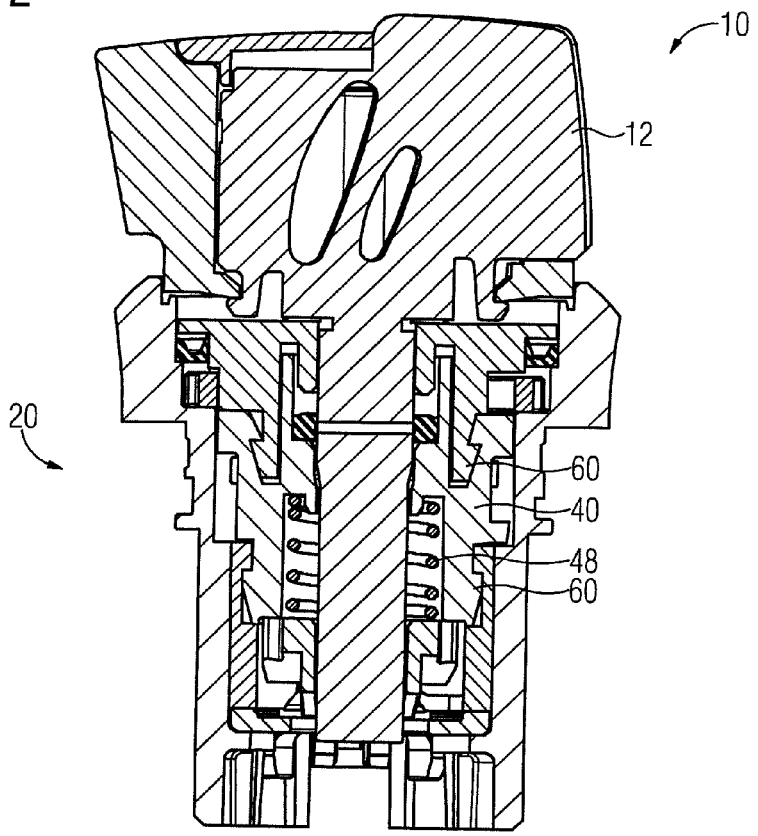
FIG. 12 shows a schematic side view of a detail of the electromechanical switching device of FIG. 4 in an assembled state.

FIG. 12 shows a schematic sectional view through the electromechanical switching device 10 of FIG. 2 in the assembled state. The latching of the rotary toggle lever 12 to the corresponding link element based on the latching via the latching hook 60 is apparent.

Figure 13:
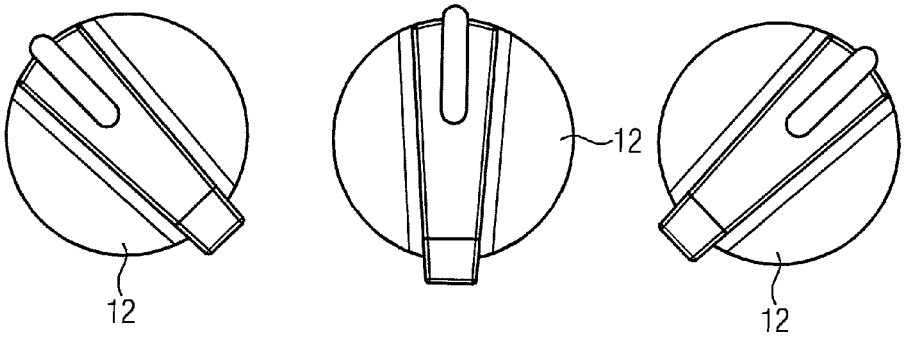
FIG. 13 shows a schematic illustration of possible home positions for the rotary toggle lever of FIG. 12.

FIG. 13 shows three possible home positions of the rotary toggle lever 12 such as can be brought about with the embodiment of FIG. 12.

Figure 14:
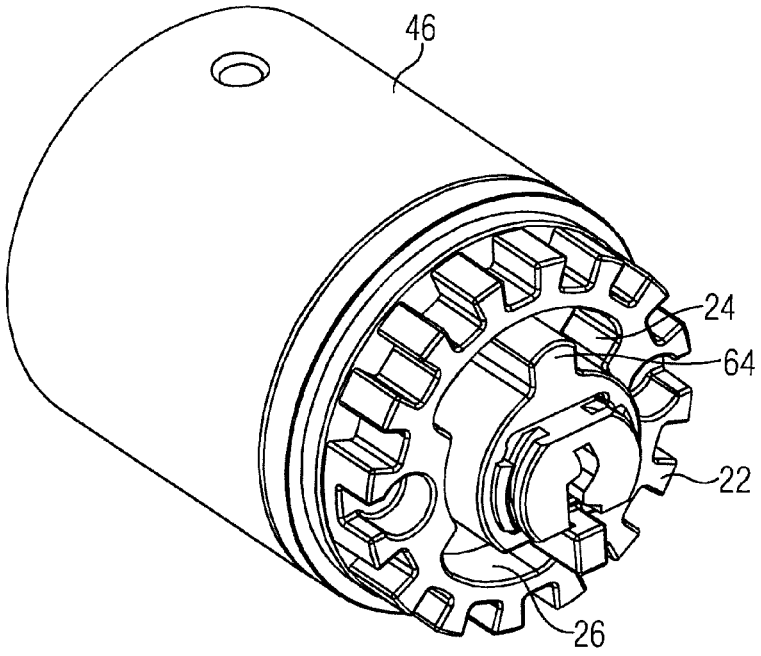
FIG. 14 shows a schematic illustration of a first embodiment of a stop disk with the activation element.
Figure 15:
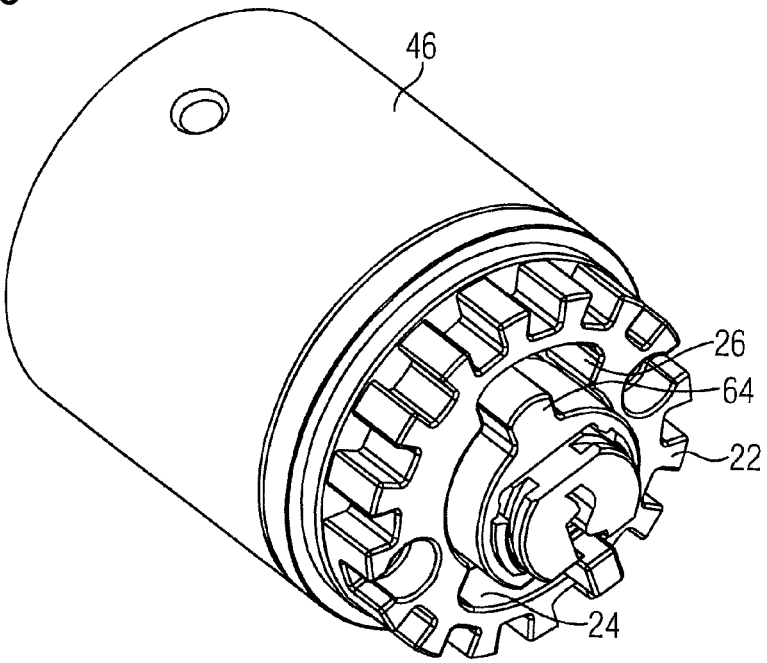
FIG. 15 shows a schematic illustration of a second refinement of the stop disk in conjunction with the activation element in a schematic-perspective view as in FIG. 14.

FIGS. 14 and 15 show a connection between the lock 46 and the stop disk 22 in a perspective-schematic view, where different rotational-angle-limiting means are provided. For this purpose, a projection 64 (here a single projection), is provided on the lock body side, where the projection 64 protrudes radially and engages in a cutout 24 (FIG. 14) or 26 (FIG. 15), specifically as a function of which rotational angle is desired.

Figure 16:
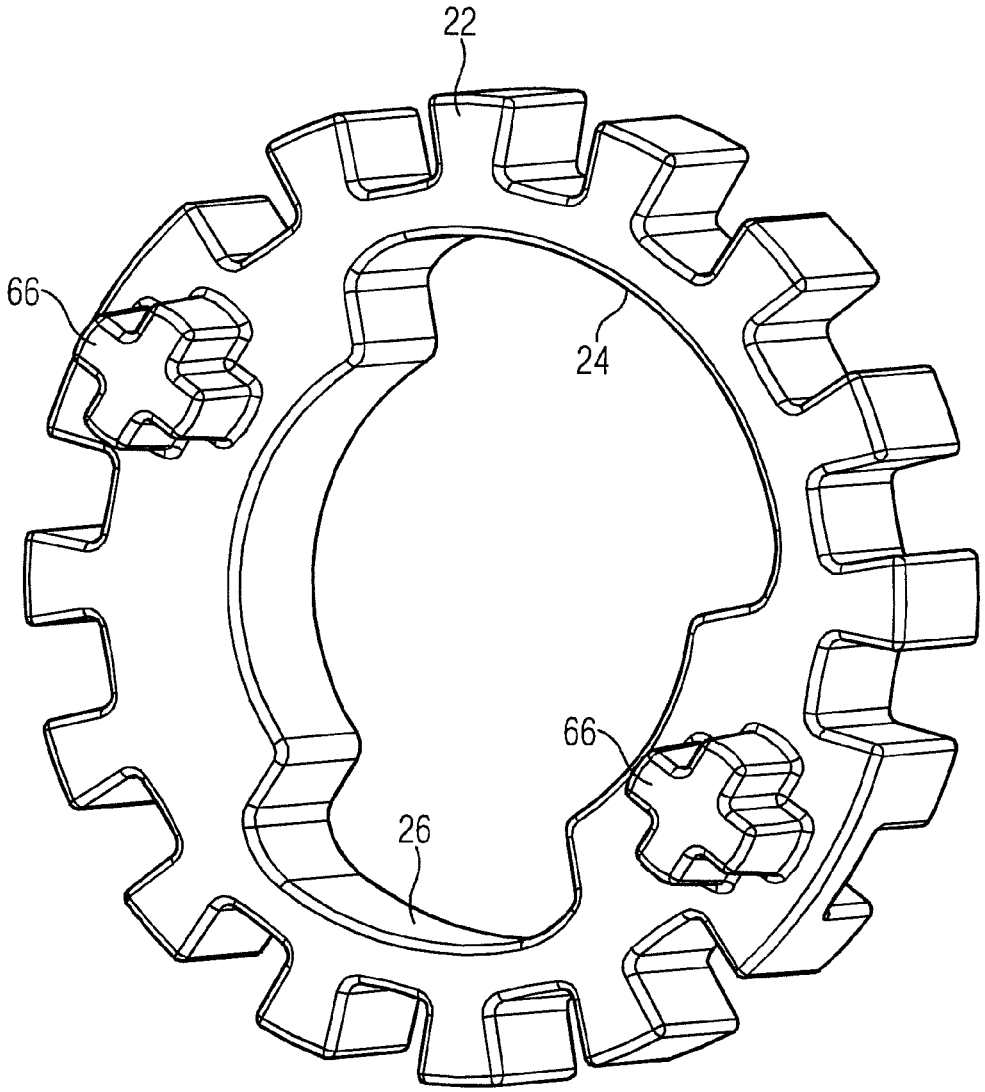
FIG. 16 shows a schematic-perspective illustration of the stop disk of FIGS. 14 and 15.

The cutouts 24, 26 make available openings and bound the rotational angle about which the key can be rotated in the lock 46. Here, the stop disk 22 is provided with two partially circumferential openings lying opposite, specifically the opening 24, on the one hand, and the opening 26, on the other. By correspondingly positioning the stop disk 22 opposite the lock 46, the desired rotational angle can be set. The projection 64 then engages in the corresponding opening 24, 26. In FIG. 14, the rotational angle is 90, whereas in FIG. 15 the rotational angle is 45. FIG. 16 shows the stop disk 22 in a perspective individual illustration from which the openings 24, 26 are apparent. The stop disk 22 can be connected in a rotationally fixed manner to a lock body of the lock 46 by further projections 66. In this way, the stop is brought about.

Figure 17:
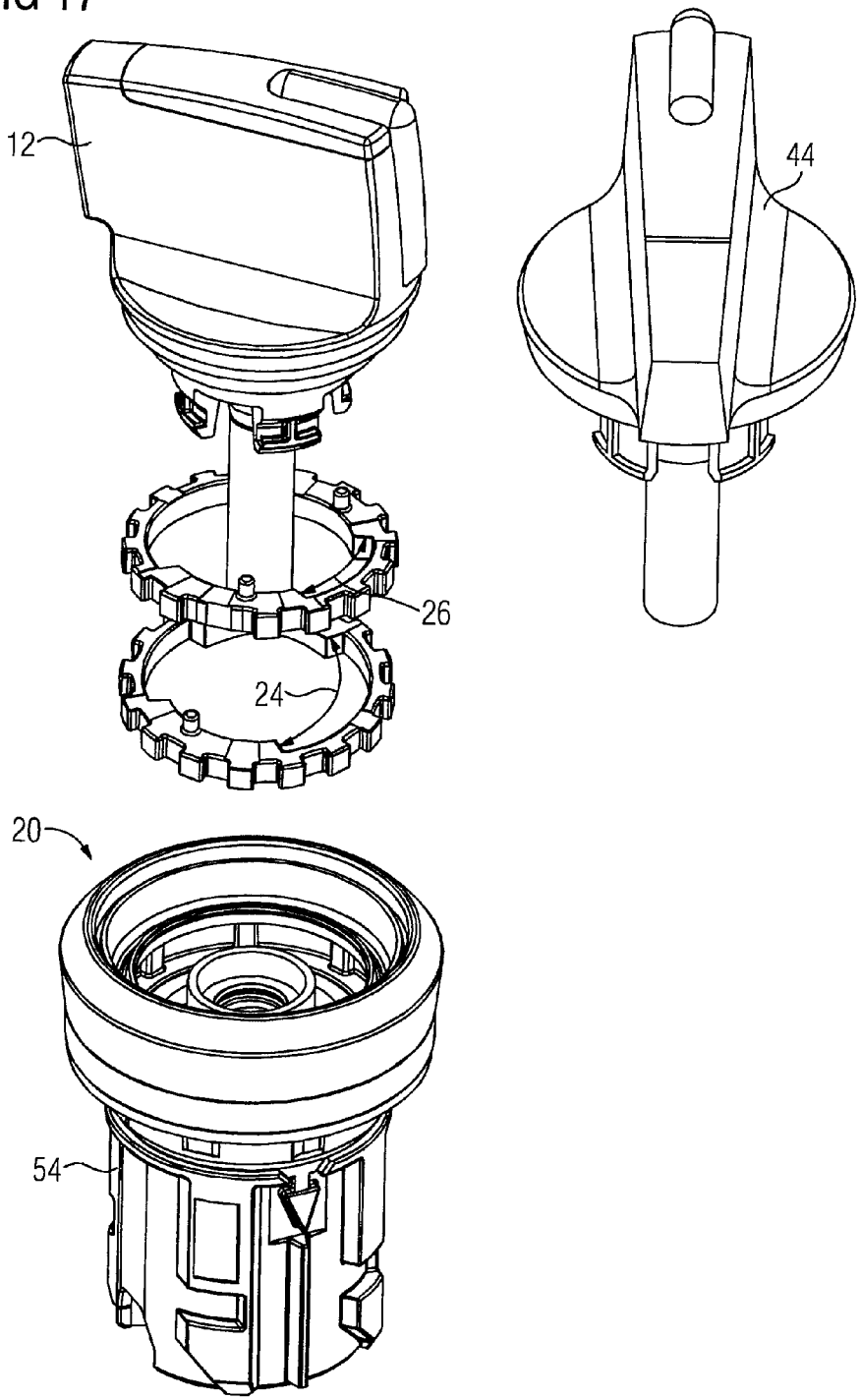
FIG. 17 shows a schematic-perspective view of a further embodiment of an electromechanical switching device in accordance with the invention, where different activation units can optionally be mounted.

FIG. 17 shows a perspective overall view of an electromechanical switching device 10 that is based on the rotary toggle lever. The desired rotary toggle lever can easily be connected, for example, in the present embodiment of the rotary toggle lever 12 or the rotary toggle lever 44, to the electromechanical switching device 10. The configuration corresponds basically to that which has already been explained with respect to FIG. 4, for which reason reference is additionally made to these statements.

The description of the present exemplary embodiments serves merely to explain the invention and is not restrictive thereto. Of course, features of the description and of the figures can be combined with one another in virtually any desired way in order to be able to arrive at further advantageous refinements within the scope of the invention.

Furthermore, device features can, of course, also be formulated as method features, and vice versa.

Thus, while there have been shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. An electromechanical switching device for making available an electrical connection between at least two terminals as a function of a switched state based on a manual activation, wherein the electromechanical switching device is configured to be arranged in a switchboard of an electrical control device, the electromechanical switching device comprising:

an activation unit which is rotatably mounted and manually activateable;

a switching unit which is connectable to the activation unit, the switching unit, the switching unit including at least one switching element which is slideably mounted in a longitudinal direction of the electro-mechanical switching device to make available the at least two electrical terminals of the electromechanical switching device and electrically connect them to one another as a function of an electrical switched state; and a coupling unit comprising a link element having a spring arranged therein, said coupling unit mechanically interconnecting the activation unit and the switching unit to one another and transmitting the manual activation of the activation unit to the switching element of the switching unit;

wherein the electromechanical switching device is formed in a modular manner via at least the activation unit, the coupling unit and the switching unit.

2. The electromechanical switching device as claimed in claim 1, wherein the coupling unit includes a rotational-angle-limiting disk having at least one rotational-angle-limiting element.

3. The electromechanical switching device as claimed in claim 2, wherein the rotational-angle-limiting disk is arranged in a rotationally fixed manner with respect to the switching unit.

4. The electromechanical switching device as claimed in claim 1, wherein the link element of the coupling unit interacts with a crown element.

5. The electromechanical switching device as claimed in claim 2, wherein the link element of the coupling unit interacts with a crown element.

6. The electromechanical switching device as claimed in claim 3, wherein the link element of the coupling unit interacts with a crown element.

7. The electromechanical switching device as claimed in claim 4, wherein the link element is rotatably mounted and connected in a rotationally fixed manner to a rotational axis of the activation unit.

8. The electromechanical switching device as claimed in claim 4, wherein the crown element is rotatably mounted with the link element and slides in the link element in the longitudinal direction of the electromechanical switching device.

9. The electromechanical switching device as claimed in claim 7, wherein the crown element is rotatably mounted with the link element and slides in the link element in the longitudinal direction of the electromechanical switching device.

10. The electromechanical switching device as claimed in claim 4, wherein the crown element is prestressed in a direction of an insertion base.

11. The electromechanical switching device as claimed in claim 4, wherein a link of the link element is mechanically connected to the switching element.

12. The electromechanical switching device as claimed in claim 1, wherein the coupling unit has a modular configuration with a crown element, the link element and a spring.

13. The electromechanical switching device as claimed in claim 4, wherein at least one of the crown element and the link element is arranged in an exchangeable manner in the coupling unit.

14. The electromechanical switching device as claimed in claim 12, wherein the coupling unit is configured as a separate module.

* * * * *